United States Patent [19]

Grüniger et al.

[11] Patent Number: 4,759,830

[45] Date of Patent: Jul. 26, 1988

[54] PROCESS FOR THE PRODUCTION OF POLYCRYSTALLINE SILICON COATINGS BY ELECTROLYTIC DEPOSITION OF SILICON

[75] Inventors: Hans R. Grüniger, Olten; Rudolf Kern, Maggia; Paul Rys, Zurich, all of Switzerland

[73] Assignee: Ciba-Geigy AG, Basel, Switzerland

[21] Appl. No.: 87,635

[22] Filed: Aug. 18, 1987

[30] Foreign Application Priority Data

Aug. 19, 1986 [CH] Switzerland ..... 3320/86

[51] Int. Cl.[4] ..... C25D 3/66

[52] U.S. Cl. ..... 204/39

[58] Field of Search ..... 204/39, 60

[56] References Cited

U.S. PATENT DOCUMENTS 3,983,012 9/1976 Cohen ..... 204/15

FOREIGN PATENT DOCUMENTS 10415 1/1983 European Pat. Off. .

OTHER PUBLICATIONS

Dennis Elwell et al., Solar Energy Materials, vol. 6, pp. 123–145 (1982).

Monnier, Chimia 37, 109–124 (1983).

Elswell, J. Crystal Growth, 52, 714–752 (1981).

Delimarskii et al., Chemical Abstracts, 96:42968j, (1982).

*Primary Examiner*—G. L. Kaplan

*Attorney, Agent, or Firm*—Wenderoth, Lind & Ponack

[57] ABSTRACT

A novel process for the electrolytic deposition of silicon from a melt containing covalent silicon compounds, in particular silicon tetrahalides, and furthermore aluminum halides, alkali metal halides and halides of transition metals is carried out at relatively low temperatures of 100° to 350° C. in an inert temperature. The silicon is deposited cathodically or anodically onto electrically conductive material.

The silicon coatings are homogeneous and adhere firmly to the substrate. The coated materials can be used for the production of photoconductive or photovoltaic devices.

12 Claims, No Drawings

PROCESS FOR THE PRODUCTION OF POLYCRYSTALLINE SILICON COATINGS BY ELECTROLYTIC DEPOSITION OF SILICON

The present invention relates to the production of thin coatings of elemental silicon on electrically conductive materials by electrolytic deposition of the silicon from low-melting mixtures containing covalent silicon compounds.

The materials thus coated can be used in the production of photoconductive or photovoltaic devices, for example solar cells.

Processes for the electrolytic deposition of silicon are already known from the literature [R. Monnier, Chimia 37, 109 (1983); and D. Elswell, J. Crystal Growth, 52, 741 (1981)].

Thus, for example, silicon can be deposited by melt electrolysis at temperatures of about 700° to 1500° C. from melts containing silicon fluorides and oxides and salts of aluminium, alkali metals and/or alkaline earth metals. The high temperatures which cause considerable material problems are a disadvantage in this process.

Another process relates to the electrochemical deposition of silicon from solutions of suitable silanes, for example tetrahalogeno- or trihalogenosilanes, dissolved in polar organic solvents. The purity of the silicon coatings deposited by this process and their continuity and adhesiveness to the electrically conductive substrate is not always completely satisfactory; the use of the materials thus coated for the intended purpose is thus also impaired. Reference should also be made to the possible but undesirable chemical reaction of the halogenosilanes mentioned with the polar organic solvents.

The object of the present invention is thus to provide a process for the electrochemical deposition of silicon which allows the production of highly pure silicon coatings, if appropriate provided only with the necessary doping agents, which are formed continuously (coherently) on the corresponding substrates and adhere firmly to these.

For this, the process according to the invention requires neither the high temperature melt electrolysis nor the silicon deposition from an organic electrolysis bath, which uses a melt of certain composition, from which polycrystalline silicon can be deposited electrochemically in thin continuous coatings onto suitable electrically conductive material at relatively low temperatures.

The present invention therefore relates to a process for the production of thin coatings of elemental silicon on an electrically conductive material which is suitable as the electrode by electrolytic deposition of the silicon from a melt, which comprises a procedure wherein the melt contains (a) a silicon halide, (b) an aluminium halide, (c) an alkali metal halide or ammonium halide and (d) a halide of a transition metal and the electrolysis is carried out at temperatures from 100° to 350° C. in an inert atmosphere, optionally under pressure.

The present invention also relates to the electrically conductive material which is obtainable according to the invention and is provided with a thin coating of elemental silicon and to the silicon coating itself, and to its use for the production of photoconductive or photovoltaic devices, for example solar cells, which can be used for direct conversion of solar energy into electrical energy.

This and the other subject matter to which the invention relates are described below in more detail.

The covalent silicon compound (a) supplies the silicon, which can be deposited, for example, cathodically. Component (b) serves to prepare a homogeneous melt (good miscibility with the silicon compounds), component (c) is the conductive salt, which, for example, can be dissolved with components (b) ($AlI_3$) to form a complex, and component (d) is the so-called catalyst which significantly improves the deposition of silicon and the quality of the silicon coatings on, for example, copper, chromium, molybdenum, nickel, iron and chrome steel or inorganic glasses, for example of tin dioxide or tin dioxide/indium oxide mixtures, and makes the formation of a silicon coating on a silicon carrier possible in the first place under the conditions of the process according to the invention. In fact, in ths latter, it would not be possible to observe deposition of silicon without this catalyst.

As an alternative to cathodic deposition of the silicon from the halide melt mentioned, it is also possible to deposit the silicon anodically.

Since aluminium halides have a higher bonding energy than the corresponding silicon halides, aluminium should be capable of reducing silicon halides. If an aluminium plate is connected as the anode in an electrolyte containing a silicon halide as component (a), a compact silicon coating is formed on its surface. Exchange of aluminium for silicon takes place. This exchange can be carried out up to complete replacement of the aluminium by silicon. A pure silicon film is obtained, but has only an inadequate stability because of the lack of a carrier. The action of the anodic current is probably based on the aluminium atoms being dissolved out of the electrode surface. Empty sites are thereby formed and can be occupied by silicon atoms after release of the bonding partner. The build-up of a silicon coating can therefore be controlled by a given flow of current. Since the solubility of aluminium in silicon is very low at the temperatures used, very pure silicon coatings can be produced. These coatings are p-conducting, since they contain traces of aluminium.

The salt melt (the electrolyte) for the anodic deposition of silicon contains components (a) to (c). This electrolytic deposition of silicon is carried out at temperatures of 100° to 350° C. in an inert atmosphere and optionally under pressure, for example under 1 to 5 bar. The anode used is an anode of aluminium, and suitable cathode materials are those of silicon or graphite.

Halides which are present as components (a) to (d) or (a) to (c) in the melt for carrying out the process according to the invention are above all the chlorides, bromides and iodides, the latter being preferred.

Component (a) is thus a silicon tetrahalide of the formula $$SiX_4 \quad (1)$$

in which X is chlorine, bromine or, preferably, iodine or mixtures thereof, such as silicon tetrachloride, silicon tetrabromide or preferably silicon tetraiodide, or furthermore, for example, $SiCBr_3$, $SiCl_2Br_2$, $SiCl_3Br$, $SiCl_2I_2$, $SiCl_3I$, $SiBr_3I$, $SiBr_2I_2$ or $SiBrI_3$; halogenosilanes of the formulae $$H_nSiX_{4-n} \quad , (2)$$

and $Si_mX'_{2m+2}$ (3)

in which n and m are integers from 1 to 3 of 2 to 6, X is chlorine, bromine, iodine or a mixture thereof and X' is chlorine, bromine or iodine, can also be used. Examples which may be mentioned are $HSiCl_3$, $H_2SiCl_2$, $HSiBr_3$, $H_2SiBr_2$, $HSiI_3$ and $H_2SiI_2$. The trihalogenosilanes are preferred.

Examples of di- and polysilanes of the formula (3) are $Si_2Cl_6$, $Si_3Cl_8$, $Si_4Cl_{10}$ and further homologues and the corresponding bromine and, in particular, iodine compounds.

In selecting compounds of component (a), optionally it should be ensured that the boiling point of this compound is not too low and the volatility is not therefore too high; electrolysis in a normal pressure range—normal pressure or slightly increased pressure—could thereby be impeded.

Component (b) is an aluminium trihalide, such as aluminium trichloride, aluminium tribromide or, preferably, aluminium triiodide; component (c), the so-called conductive salt, is the chloride, bromide or, preferably, iodide of sodium, potassium or, preferably, lithium; ammonium halides, such as, for example, ammonium chloride, bromide or iodide, and lower($C_1$–$C_4$)tetraalkyl or -alkanolammonium halides are also suitable (tetraethylammonium and tetrabutylammonium halides); and component (d), the so-called catalyst, is a chloride, bromide or, preferably, iodide of a transition metal.

By transition metals in this connection there are understood the metals which are in the so-called subgroups (B groups, IB–VIIB and VIII) of the periodic table of the elements. Representatives of these groups which may be mentioned are copper, zinc, scandium and the lanthanides, for example erbium or gadolinium; and titanium, vanadium, chromium, manganese, iron, cobalt and nickel (compare N.A. Lange, Handbook of Chemistry, 10th ed. 1961, Mc Graw Hill Book Co.).

Preferred halides of these transition metals which are suitable as catalysts are chromium(II) iodide ($CrI_2$), manganese(II) iodide ($MnI_2$), iron(II) iodide ($FeI_2$), nickel iodide ($NiI_2$), copper(I) iodide (CuI), hafnium(IV) iodide ($HFI_4$) or vanadium(II) iodide ($VI_2$).

Mixtures of the halides mentioned as component (d) can also be used, for example those of $VI_2$ and $NiI_2$, $NiI_2$ and $FeI_2$, $FeI_2$ and $CrI_2$, $VI_2$, $NiI_2$ and $FeI_2$ or $NiI_2$, $FeI_2$ and $CrI_2$, it being possible for their mixing ratios to have wide limits.

The salt melts used in the process according to the invention preferably contain silicon tetrabromide or silicon tetraiodide as component (a), aluminium triiodide as component (b), lithium iodide as component (c) and vanadium(II) iodide or, in particular, the above-mentioned salt mixtures as component (d).

Components (a) to (c) can also be mixtures of the halides mentioned.

Components (a) to (d) are employed in the melt in approximately the following amounts: 20 to 90, preferably 20 to 75% by weight of component (a), 5 to 95, preferably 20 to 60% by weight of component (b), 1 to 20% by weight of component (c) and 0.1 to 10% by weight of component (d).

In particular, the melt contains the components in the following amounts: 40 to 75% by weight of component (a), 20 to 50% by weight of component (b), 1 to 12% by weight of component (c) and 0.1 to 5% by weight of component (d).

Components (a) to (d) must have a very high chemical purity. Appropriate processes for the preparation of such highly pure compounds are known from the literature (compare, for example, R. C. Ellis, J. Elektrochem. Soc. 107, 222 (1960)—Herstellung von Siliziumtetrajodid und Verwendung zur Herstellung von Silizium [Preparation of silicon tetraiodide and use for the preparation of silicon]).

The preparation of pure aluminium iodide and lithium iodide is described below.

The process according to the invention can be carried out in an electrolysis vessel of the customary construction. The vessel can be made, for example, of glass, in particular quartz glass, or of a non-corroding metal, and if appropriate can contain a porous sinter plate of quartz, a metal or a ceramic material as the partition between the anode and cathode chamber. Such a partition can prevent, for example, the anodically (use of an inert anode) formed halogen (for example $Cl_2$ or $I_2$) being converted back on the cathode.

However, since the halogens formed escape rapidly from the electrode chamber at the temperatures required according to the invention for the electrochemical deposition of silicon, as a rule a partition between the anode and cathode chamber is not necessary.

The gaseous halogens which escape can be collected and removed in a fractionating column connected to the electrolysis vessel.

If the deposition of silicon is carried out at a given cathodic potential, as a rule a reference electrode separated from the cathode chamber by a diaphragm (porous sinter plate) is used. A suitable reference electrode consists, for example, of highly pure aluminium (99.999%), which is in an aluminium halide/alkali metal halide melt (for example $AlI_3$/LiI) (reference element). The reference electrode is used as the third currentless electrode. With this electrode, for example, the electrical conditions (for example changes in potential) during the electrolysis process can be controlled.

Suitable electrode materials for the cathodic deposition of silicon are: metals/alloys or metalloids or nonmetals which are corrosion-resistant under the conditions of the electrochemical deposition, such as copper, chromium, molybdenum, nickel, iron, platinum or stainless steels, for example chrome steel, and preferably aluminium, silicon or graphite as the cathode material and platinum, silicon or graphite as the (inert) anode material. Particularly corrosion-resistant materials are molybdenum, platinum, graphite and silicon. For anodic deposition of silicon, the anode material is aluminium, as stated, whilst the cathodes are preferably graphite or silicon.

The silicon anodes can be etched before use with a mixture of 5 parts of nitric acid, 3 parts of concentrated hydrofluoric acid, 3 parts of acetic acid and 0.1 part of bromine. Their surfaces are then such that they can hardly be attacked anodically and thus serve as inert anodes.

The operating temperature of 100° to 350° C. for carrying out the process according to the invention is achieved by indirect heating of the electrolysis vessel, for example with a suitable electrically heated heating bath. For melts which contain the individual components as iodides, temperature ranges of preferably 200° to 350° C. and in particular 260° to 320° C. can be stated.

The electrochemical deposition of the silicon is carried out at a current density of about 0.5 to 20, preferably 1 to 20 and in particular 1 to 10 or 1 to 5 $mA/cm^2$.

The electrochemical deposition of silicon can be carried out galvanostatically or potentiostatically using a customary energy source.

The current yield (current consumption) is in the range from about 50 to 100%, and is as a rule 100%, and thus corresponds to the theoretical value and indicates that virtually no side reactions, for example dimer or polymer formation, whereby the current yield could be reduced, take place.

The duration of the electrochemical deposition depends on the thickness of the desired silicon coating and therefore varies within wide limits. For example, a time span of about 1 to 24, preferably 1 to 10 hours can be mentioned. The thickness of the silicon coating on the electrically conductive bodies used as the electrode can be stated as 0.01 to 300, preferably 0.01 to 100 $\mu$m.

Since the highly pure compounds (for example components (a) and (b)) used in the process according to the invention are sensitive to atmospheric humidity, the electrochemical deposition of silicon is carried out in an inert atmosphere under normal pressure, or optionally under an increased pressure of about 1 to 5 bar. Before the start of the process, the electrolysis cell is flushed with an inert gas, for example nitrogen or argon, and an inert gas atmosphere is thus provided and remains throughout the entire duration of the process. Components (a) to (d) are also as a rule introduced into the electrolysis cell under inert conditions (dry box).

Uniform polycrystalline silicon coatings which have a relatively large area and are firmly bonded to the electrically conductive substrate can be produced by the process according to the invention. The coated materials thus obtained exhibit very good electrical and thermal conductance, so that they can be used, for example, for the production of or in photoconductive or photovoltaic devices. Photovoltaic devices are, for example, (silicon) solar cells which are capable of converting light energy into electrical energy (photo-voltaic effect).

Doping to give a p- or n- (p=positive, n=negative charge carrier) conducting material can be achieved by appropriate addition of suitable compounds during the electrochemical deposition of a silicon. Examples of suitable compounds are $BI_3$, $GaI_3$ or $InI_3$ for the production of p-conducting material and $PI_3$, $AsI_3$ or $SbI_3$ for the production of n-conducting material.

For the aluminium iodide and lithium iodide required, inter alia, in the process according to the invention for the production of silicon coatings, new processes for the preparation of these compounds in a very pure form are described below. The following can be stated specifically for these:

Aluminium iodide is usually prepared from the elements (aluminium and iodine) at a relatively high temperature in an inert atmosphere. It contains iodine and certain impurities from the starting components as by-products. Purification of the aluminium iodide thus obtained is very cumbersome. If very pure starting materials (aluminium and iodine) are used, the reaction takes place only very slowly and incompletely.

It has now been found—and the present invention also relates to this—that very pure aluminium iodide can be prepared from aluminium and hydrogen iodide, the hydrogen iodide advantageously being formed in situ from iodine and hydrogen. The hydrogen iodide can be prepared from iodine and hydrogen in the presence of a platinum catalyst at about 500° C..

It is also possible to carry out the reaction without a platinum catalyst and therefore to avoid contamination of the hydrogen iodide and platinum, if the reaction is allowed to proceed in the presence of traces of water at temperatures of about 600° to 800° C.

The process according to the invention for the preparation of aluminium iodide ($AlI_3$) from aluminium and hydrogen iodide comprises reacting (1) pure aluminium, optionally etched with hydrochloric acid, at temperatures of 300° to 500° C., preferably 350° to 450° C., in the presence of catalytic amounts of water, with (2) hydrogen iodide.

The hydrogen iodide is advantageously prepared in situ from iodine and hydrogen at temperatures of 600° to 800° C. in the presence of catalytic amounts of water and is used directly for the further reaction with aluminium.

The catalytic amounts of water are introduced into the process, for example, by passing the hydrogen through a wash bottle containing water before reaction with the iodine.

The preferred component (c)—lithium iodide—can be in the form of the mono-, di- or trihydrate and is usually purified by recrystallization of the trihydrate ($LiI.3H_2O$) from water.

It has been found—and the present invention "furthermore also relates to this—that a very pure product is obtained by zone melting of the trihydrate mentioned at 60° to 100° C., preferably 60 to 80° C. and can be dehydrated by subsequent drying, the procedure being carried out at temperatures up to 250° C. in vacuo.

The mono- or dihydrate mentioned can also be used for the zone melting process, in which case temperatures of 50° to 140° C. are suitable.

The invention is illustrated in more detail in the following examples, but without being limited thereto.

Unless indicated otherwise, parts and percentages relate to the weight.

EXAMPLE 1

(a) A rectangular plate of silicon (dimensions 40/8/2 mm) which has been sawn off from a silicon monocrystal is treated in a 20% alkaline-aqueous solution of a commercially available surfactant at 90° C. for 1 hour, washed with doubly distilled water and then dried at 150° C. in air.

The silicon monocrystal is drawn from a silicon melt by known processes; it is rendered p- or n-conducting by appropriate doping and has a resistance of 0.04 Ohm cm.

The silicon plate cleaned as described is incorporated as the cathode in an electrolysis cell. The anode consists of graphite or silicon.

The anode and cathode chamber can be separated from one another by a porous sinter plate in order to prevent the halogen from possibly being converted back at the cathode. As a rule, however, the halogen (iodine) escapes so quickly from the electrolysis cell that it is not necessary to separate the anode and cathode chamber. The halogen which escapes can be recovered, for example, by condensation.

A compound mixture consisting of 73% by weight of $SiI_4$, 22% by weight of $AlI_3$, 3.5% by weight of LiI and 1.5% by weight of $VI_2$ is introduced into the electrolysis cell and is then electrolysed at 310° C. and at a current density of 2 mA/cm$^2$ for 4 hours. The voltage depends on the distance between the electrodes. It is, for example, in the range from 300 to 500 mV. The electrolysis is carried out under inert conditions in a closed system. For this, the electrolysis cell is flushed with nitrogen or argon before the electrolysis; the inert gas atmosphere is maintained during the electrolysis.

The current yield measured is somewhat greater than 100%, probably because of a certain thermal decomposition of the $SiI_4$ during the electrolysis.

When the electrolysis has ended, a continuous, firmly adhering silicon coating about 10 μm thick has formed on the silicon plate. The material thus coated has a very good electrical and thermal conductance.

(b) A silicon coating which is likewise continuous and firmly adhering is obtained if a salt melt of 43% by weight of $SiI_4$, 43% by weight of $AlI_3$, 12% by weight of LiI and 2% by weight of $VI_2$ is electrolysed as described under (a) but at a current density of 5 mA/cm$^2$. The current yield is 100%.

(c) Salt melts of the following compositions ($c_1$) 73% by weight of $SiI_4$, 22% by weight of $AlI_3$, 3.5% by weight of LiI, 0.75% by weight of $VI_2$ and 0.75% by weight of $NiI_2$; ($c_2$) 73.5% by weight of $SiI_4$, 22% by weight of $AlI_3$, 3.7% by weight of LiI, 0.65% by weight of $NiI_2$ and 0.15% by weight of $FeI_2$; ($c_3$) 73% by weight of $SiI_4$, 21.9% by weight of $AlI_3$, 3.5% by weight of LiI, 1.5% by weight of $CrI_2$ and 0.1% by weight of $FeI_2$; ($c_4$) 73% by weight of $SiI_4$, 22% by weight of $AlI_3$, 3.4% by weight of LiI, 0.75% by weight of $VI_2$, 0.75% by weight of $NiI_2$ and 0.1% by weight of $FeI_2$; and ($c_5$) 73.5% by weight of $SiI_4$, 22% by weight of $AlI_3$, 3.74% by weight of LiI, 0.37% by weight of $NiI_2$, 0.37% by weight of $CrI_2$ and 0.02% by weight of $FeI_2$ are electrolysed in an electrolysis cell according to Example (1a) at in each case 320° C. and at a current density of in each case 2.5 mA/cm$^2$ for 4 hours. The voltage depends on the distance between the electrodes. It is, for example, in the range from 300 to 500 mV. The electrolysis operations are carried out under inert conditions in a closed system. For this, the electrolysis cell is in each case flushed with nitrogen or argon before the electrolysis; the inert gas atmosphere is maintained during the electrolysis.

When the electrolysis has ended, a continuous firmly adhering silicon coating about 5 to 10 μm thick has formed on each of the silicon plates. The materials thus coated exhibit a very good electrical and thermal conductance.

The silicon is deposited with a greater or lesser ease depending on the catalyst, the nature of the surface of the electrode and the presence of traces of oxygen or water which can react with the electrolyte to give surface-active species. The current yields therefore vary between 50 and 100% and greater or smaller amounts of the catalyst can also be deposited.

EXAMPLE 2

A plate of highly pure aluminium (99.99%) is treated in a 20% alkaline-aqueous solution of a commercially available surfactant at room temperature for one hour and then dried in air at 150° C.

The aluminium plate is then polarized anodically at 260° to 270° C. at a current density of 2 mA/cm$^2$ for 20 minutes and subsequently used as the cathode in an electrolysis process according to Example 1(a).

The deposition of silicon is accelerated and the quality of the silicon coating is improved by the anodic polarization of the aluminium cathode. A (partial) exchange of aluminium for silicon probably takes place on the aluminium surface before the actual deposition of the silicon. The cathodically deposited silicon adheres better to this surface than to aluminium itself.

After an electrolysis time of 4 hours, a continuous firmly adhering silicon coating about 10 μm thick has formed on the aluminium plate. The current yield is 100%.

The coated material also has the properties described in Example 1(a).

EXAMPLE 3

(a) A rectangular milled aluminium plate (purity: 99.99%, dimensions 40/8/2 mm) is cleaned with methylene chloride in an ultrasonic bath and then rinsed with methylene chloride. It is then rubbed under dry conditions with emery paper and finally polished with a suspension of aluminium oxide in isopropanol. The polished plate is cleaned with isopropanol in an ultrasonic bath, rinsed with acetone and dried at room temperature.

The aluminium plate thus cleaned is incorporated as the anode in an electrolysis cell according to Example 1(a). The cathode consists of graphite or silicon. A compound mixture consisting of 74.2% by weight of $SiI_4$, 22.1% by weight of $AlI_3$ and 3.7% by weight of LiI is introduced into the electrolysis cell under inert conditions in an appropriately closed housing (dry box). The electrolysis cell is then removed from this housing and heated to about 320° C. until the mixture boils. Inert conditions are maintained in the electrolysis cell by passing in nitrogen (slight increased pressure). After complete mixing of the electrolytes, the mixture is cooled to 260° to 270° C. Electrolysis is then carried out with a current density of 10 mA/cm$^2$ for 20 minutes and then with 1 mA/cm$^2$ for 5 hours. The electrodes are then cooled by a stream of nitrogen and cleaned with propionitrile and alcohol. A continuous firmly adhering silicon coating about 50 μm thick has formed on the aluminium plate. The material thus coated exhibits a very good electrical and thermal conductance.

(b) The procedure followed is as described under (3a), but instead of the direct current a pulse current is used: 2 seconds - 10 mA/cm$^2$, 20 seconds - 0.5 mA/cm$^2$, 2 seconds- 10 mA/cm$^2$ and so on, duration: 5 hours. Or: 5 seconds- 10 mA/cm$^2$, 20 seconds - 0.5 mA/cm$^2$, 5 seconds - 10 mA/cm$^2$ and so on, duration: 3 hours. When the electrolysis has ended, a continuous firmly adhering silicon coating about 75 μm thick has formed on the aluminium plate. The material thus coated exhibits a very good electrical and thermal conductance.

(c) An aluminium platelet (99.99%) is ground to a thickness of 100 um and prepared as described in (3a). Electrolysis is then carried out as described with a current density of 5 mA/cm$^2$ for 4 hours. The portion of the aluminium platelet immersed in the electrolyte is completely replaced by silicon. A silicon film is formed.

The aluminium iodide formed can be separated off and split back into aluminium and iodine by electrolysis.

EXAMPLE 4

Preparation of aluminium iodide ($AlI_3$)

Device for carrying out the process: a flask for accommodating the iodine, which can be heated and is equipped with a gas inlet tube, is connected to a vertically arranged reaction tube of quartz glass surrounded by a heating jacket. The hydrogen iodide is synthesised in this tube. The reaction tube is connected to a fractionating column filled with glass bodies. This fractionating column is kept at about 120° C. during the reaction. The reflux from thin fractionating column flows via a line which can be heated (also heated to about 120° C.) back into the flask which can be heated, in which the iodine boils at the reflux temperature (185° C.). At the top of the fractionating column is a condenser which is kept at room temperature in order to condense residual iodine. The condenser is heated up to temperatures above the melting point of iodine from time to time in order to melt the condensed iodine, which then flows back via the fractionating column into the flask which can be heated. Downstream of the condenser is also a cold trap (−20° C.), in which the last traces of iodine and impurities are separated off.

Since the reaction of iodine with hydrogen does not proceed to completion at the temperature stated, iodine can be separated off from the hydrogen iodide and hydrogen with the aid of this device and recycled into the reservoir flask which can be heated. Continuous synthesis of hydrogen iodide is possible in this way. The iodine in the flask boils permanently under reflux (185° C.) and a continuous stream of hydrogen is passed in through the gas inlet tube.

The cold trap is connected to a second reaction tube which contains the aluminium, in which the reaction with the hydrogen iodide gives aluminium iodide ($AlI_3$) takes place.

The aluminium iodide formed flows with the stream of gas (hydrogen) to the end of the reaction tube and condenses there in a flask. The hydrogen recovered from the reaction and the unreacted hydrogen is removed at the end of the apparatus by wash bottles (sulfuric acid or liquid paraffin) or recycled to the flask containing the iodine.

Process: Turned aluminium filings (purity 99.999%) are washed in methylene chloride, etched with half-concentrated (18%) hydrochloric acid, rinsed with doubly distilled water and finally dried in air at 120° C.

The dried aluminium filings are introduced into the second reaction tube and the iodine is introduced into the flask which can be heated. The apparatus is then flushed with argon for one hour in order to remove the air.

The first reaction tube is then heated at 750° C., the second is heated at 400° C. and the flask which can be heated, which contains the iodine, is heated to the reflux temperature (185° C.) of iodine. A weak reflux of the iodine is maintained in this flask.

The inert argon atmosphere within the reaction apparatus is then displaced by a stream of hydrogen.

In order to start the reaction, hydrogen is first passed through a wash bottle containing water and from there into the flask which can be heated and contains iodine. The stream of hydrogen is adjusted so that it flows through the first reaction tube within about 30 seconds. From time to time, the stream of hydrogen is passed through the wash bottle mentioned, in order to activate the formation of hydrogen iodide and aluminium iodide again.

The colourless $AlI_3$ thus obtained is spectroscopically pure. No troublesome impurities were to be detected.

EXAMPLE 5

Preparation of lithium iodide (LiI)

Ground lithium iodide trihydrate is introduced into a quartz tube under an inert gas. The salt is melted to a coherent block with industrial hot air. The tube is closed and fixed horizontally in a zone melting apparatus. The quartz tube is only about half-full, and therefore cannot break during the melt operation.

Zone melting is carried out by passing the heating ring slowly (about 1–2 cm/hour) over the quartz tube. The impurities in the lithium iodide migrate with the melt zone during the zone melting (70° to 80° C.) and collect at the ends of the quartz tube. After about 20 melting cycles, the process is ended, the tube is cooled and broken into several pieces, the salt is melted out in an inert atmosphere and the solidified melt is then ground.

The lithium iodide trihydrate thus obtained is spectroscopically pure and contains no troublesome impurities.

The trihydrate is then dried in vacuo ($10^{-3}$ mm Hg$=1.3\times10^{-3}$ mbar) as follows: 24 hours at room temperature, 12 hours each at 50°, 100°, 150° and 200° C. and finally 48 hours at 250° C.

What is claimed is:

1. A process for the production of a thin coating of elemental silicon on an electrically conductive material suitable as an electrode by electrolytic deposition of the silicon from a salt melt, by a procedure in which the salt melt contains (a) a silicon halide, (b) an aluminium halide, (c) an alkali metal or ammonium halide and (d) a halide of a transition metal and the electrolysis is carried out at temperatures from 100° to 350° C. in an inert atmosphere, optionally under pressure.

2. The process according to claim 1, wherein the salt melt contains (a) silicon halides of the formula $$SiX_4, \quad (1)$$

$$H_nSiX_{4-n} \text{ or} \quad (2)$$

$$Si_mX'_{2m+2} \quad (3)$$

in which X is chlorine, bromine, iodine or mixtures thereof, X′ is chlorine, bromine or iodine, n is an integer from 1 to 3 and m is an integer from 2 to 6, (b) aluminium trichloride, aluminium tribromide or aluminium triiodide, (c) a chloride, bromide or an iodide of sodium, potassium or lithium, and (d) a chloride, bromide or an iodide of a transition metal, it also being possible for components (a) to (d) to be present as mixtures of the compounds mentioned.

3. The process according to claim 2, wherein component (a) is silicon tetrachloride, silicon tetrabromide or silicon tetraiodide.

4. The process according to claim 2, wherein the melt contains chromium(II) iodide ($CrI_2$), manganese(II) iodide ($MnI_2$), iron(II) iodide ($FeI_2$), copper(I) iodide (CuI), hafnium(IV) iodide ($HfI_4$), nickel iodide ($NiI_2$), vanadium(II) iodide ($VI_2$) or mixtures of these iodides as component (d).

5. The process according to claim 2, wherein an aluminium triiodide is used which has been obtained by reaction of (1) pure aluminium, optionally etched with hydrochloric acid, at temperatures of 300° to 500° C. in the presence of catalytic amounts of water with (2) hydrogen iodide.

6. The process according to claim 5, wherein the hydrogen iodide is prepared in situ from iodine and hydrogen at temperatures of 600° to 8° C. in the presence of catalytic amounts of water and is used directly for further reaction with the aluminium.

7. The process according to claim 2, wherein a lithium iodide which has been obtained by zone melting of lithium iodide trihydrate at 60° to 100° C., and subsequent dehydration in vacuo at temperatures of up to 250° C. is used.

8. The process according to claim 1, wherein the salt melt contains 20 to 90% by weight of component (a), 5 to 95% by weight of component (b), 1 to 20% by weight of component (c) and 0.1 to 10% by weight of component (d).

9. The process according to claim 8, wherein the melt contains 20 to 75% by weight of component (a), 20 to 60% by weight of component (b), 1 to 20% by weight of component (c) and 0.1 to 10% by weight of component (d).

10. The process according to claim 1, wherein the electrolytic deposition of the silicon is carried out at temperatures of 260° to 320° C., optionally under a pressure of 1 to 5 bar, with a melt which contains silicon tetraiodide, aluminum iodide, lithium iodide and a transition metal iodide or a mixture of transition metal iodides as components (a) to (d).

11. The process according to claim 1, wherein the electrolysis is carried out at a current density of 1 to 20 $mA/cm^2$.

12. The process according to claim 1, wherein the electrolytic deposition of the silicon is carried out cathodically, the cathode material used being copper, chromium, molybdenum, nickel, platinum, iron, stainless steel, aluminium, silicon or graphite, and the anode material used being platinum, silcon or graphite.

* * * * *